US007274143B2

(12) United States Patent
Okada

(10) Patent No.: US 7,274,143 B2
(45) Date of Patent: Sep. 25, 2007

(54) PLASMA DISPLAY PANEL

(75) Inventor: Takeru Okada, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 217 days.

(21) Appl. No.: 11/111,829

(22) Filed: Apr. 22, 2005

(65) Prior Publication Data

US 2005/0236992 A1 Oct. 27, 2005

(30) Foreign Application Priority Data

Apr. 26, 2004 (JP) ..... 2004-129361

(51) Int. Cl.
*H01J 17/49* (2006.01)

(52) U.S. Cl. ..... 313/582; 313/586; 313/587

(58) Field of Classification Search ..... 313/582, 313/586, 587
See application file for complete search history.

(56) References Cited

FOREIGN PATENT DOCUMENTS

| | | | |
|---|---|---|---|
| EP | 0 779 643 A2 | | 6/1997 |
| EP | 0 779 643 A3 | | 3/1999 |
| EP | 1 085 554 A1 | | 3/2001 |
| EP | 1 164 625 A2 | | 12/2001 |
| EP | 1 164 625 A3 | | 8/2004 |
| JP | 2000-067759 | | 3/2000 |
| JP | 2000-067759 A | | 3/2000 |
| JP | 2002-358897 A | | 12/2002 |
| JP | 2002358897 A | * | 12/2002 |

* cited by examiner

*Primary Examiner*—Vip Patel
(74) *Attorney, Agent, or Firm*—Arent Fox LLP

(57) ABSTRACT

A plasma display panel has a pair of substrates placed opposite each other with a discharge space in between, electrodes formed on an inner face of one of the pair of substrates, a dielectric layer covering the electrodes, and a protective layer covering the dielectric layer, a discharge gas filling the discharge space. The protective layer includes a cesium-based complex oxide.

6 Claims, 2 Drawing Sheets

SECTION V-V

SECTION W-W

EMBODIMENT

SECTION V-V

SECTION W-W

PLASMA DISPLAY PANEL

BACKGROUND OF THE INVENTION

1. Field of the Invention

This invention relates to a structure of plasma display panels.

The present application claims priority from Japanese Application No. 2004-129361, the disclosure of which is incorporated herein by reference.

2. Description of the Related Art

Some typical display apparatuses include a plasma display panel (hereinafter referred to as "PDP") having a hermetically sealed discharge space filled with a discharge gas in which discharge is produced for generating an image, for example.

Such a type of display apparatus is conventionally equipped with a high-spattering-resistant protective layer that covers the display-space-facing area of a structural component of the display apparatus for the purpose of preventing the structural component of the display apparatus from being spattered by plasma generated at the time when a discharge is produced in the discharge space.

Materials for forming the protective layer for protecting a dielectric layer need to have certain characteristics, such as long life, strong resistance to spattering, and a high coefficient of secondary electron emission for the purpose of reducing the discharge starting voltage. Typically magnesium oxide (MgO) is used as the material.

In recent years, the foregoing display apparatuses have been popularized, particularly, in the form of a large-sized slim flat display for displaying a HDTV image, and thereby an increase in definition and an increase in screen size have been promoted. For furthering the advance of popularization, a reduction in power consumption, an increase in brightness and an increase in light-emitting efficiency are required.

A conventional display apparatus proposed for responding to those requirements has a protective layer including cesium which is a simple substance in the alkali metal series, or alternatively a cesium layer formed on a protective layer.

Such a conventional display apparatus is disclosed in Japanese Patent Laid-open Publication 2000-67759, for example.

However, cesium being a simple substance has conductivity and lacks the so-called memory effect of accumulating wall charges. Thus, the simple substance cesium is unsuitable for alternative-current plasma display panel.

Further, the simple substance cesium shows very high activity and immediately undergoes oxidation in the atmosphere, resulting in cesium hydroxide. For this reason, cesium has the disadvantages that the deposition of a layer in the manufacturing process is difficult and the layer of the simple substance cesium is very susceptible to spattering.

Therefore, the development of a plasma display panel having a reliable protective layer capable of causing a further improvement in discharge characteristics is required.

SUMMARY OF THE INVENTION

An object of the present invention is to solve the problems associated with conventional plasma display panels as described above.

To attain this object, the present invention provides a plasma display panel having a pair of substrates placed opposite each other with a discharge space in between, electrodes formed on an inner face of one of the pair of substrates, a dielectric layer covering the electrodes, and a protective layer covering the dielectric layer, with a discharge gas filling the discharge space. The protective layer of this plasma display panel includes a cesium-based complex oxide.

In a preferred embodiment of the present invention, a plasma display panel has a protective layer provided for protecting a dielectric layer, covering row electrode pairs, on an inner face of a front glass substrate which is placed opposite a back glass substrate with a discharge space in between. The protective layer is formed of a cesium-based complex oxide, such as $Cs_2CO_3$, $Cs_2SO_4$, $Cs_2No_3$, or a complex oxide represented by the general formula Csx (AyOz) or Csx(AByOz), for example.

In the plasma display panel according to the embodiment, the protective layer protecting the dielectric layer facing the interior of the discharge space is formed of a cesium complex oxide, which then makes it possible to reduce the discharge voltage to a level lower than an MgO-made protective layer and improve the light-emitting efficiency.

The protective layer of this plasma display panel has a high resistance to spattering than a protective layer formed of simple substance cesium. Further, the cesium complex oxide is stable in the atmosphere, thus facilitating the formation of the protective layer.

These and other objects and features of the present invention will become more apparent from the following detailed description with reference to the accompanying drawings.

DETAILED DESCRIPTION OF THE PREFERRED EMBODIMENT

Figure 1:
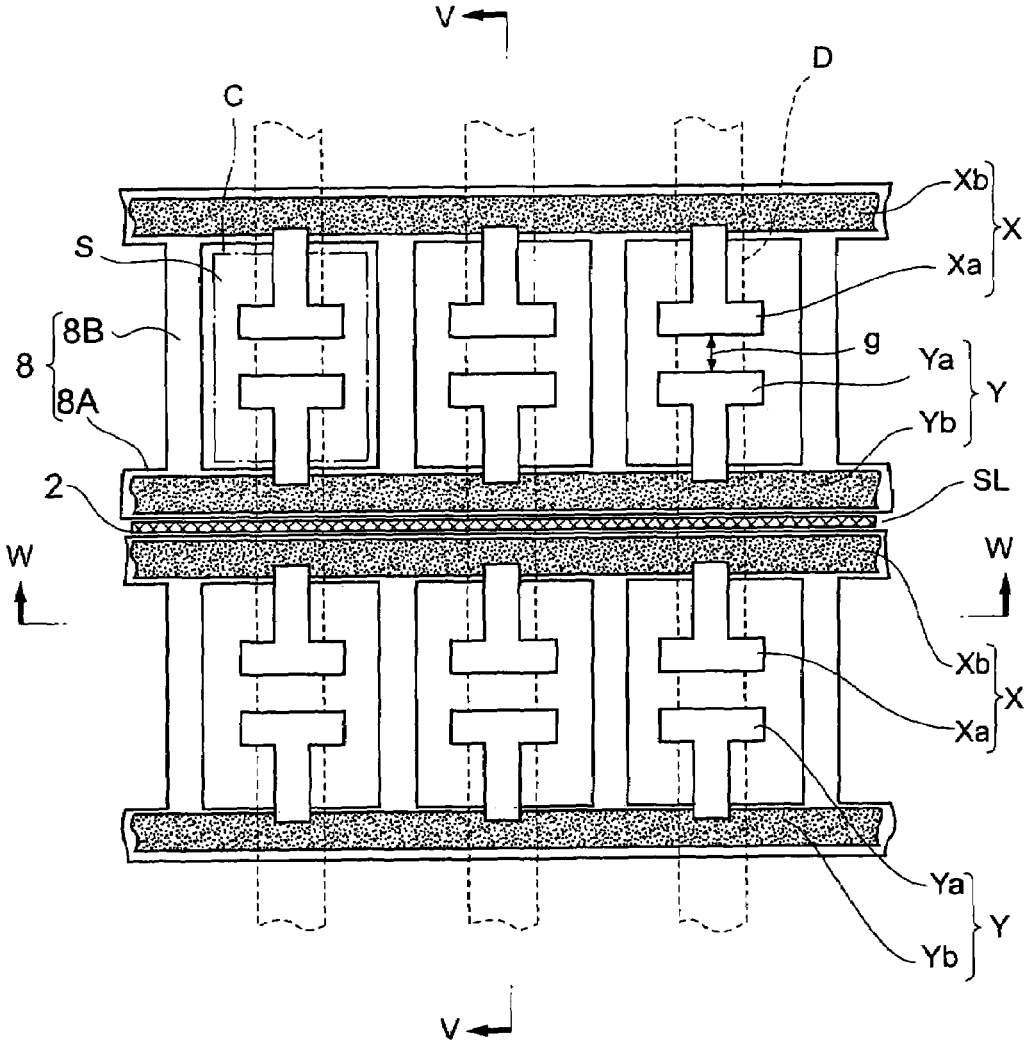
FIG. 1 is a front view illustrating an embodiment of a PDP according to the present invention.
Figure 2:
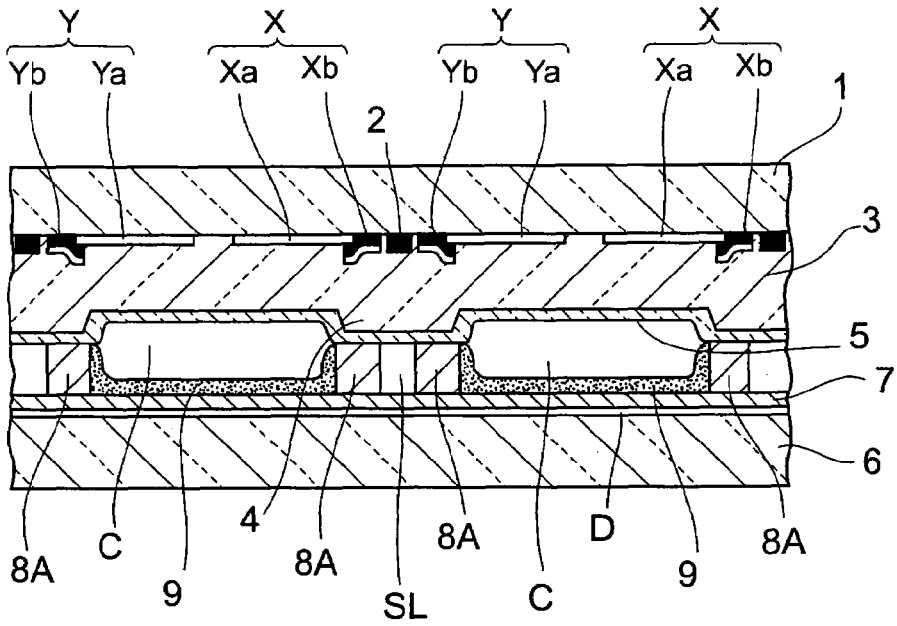
FIG. 2 is a sectional view taken along the V-V line in FIG. 1.
Figure 3:
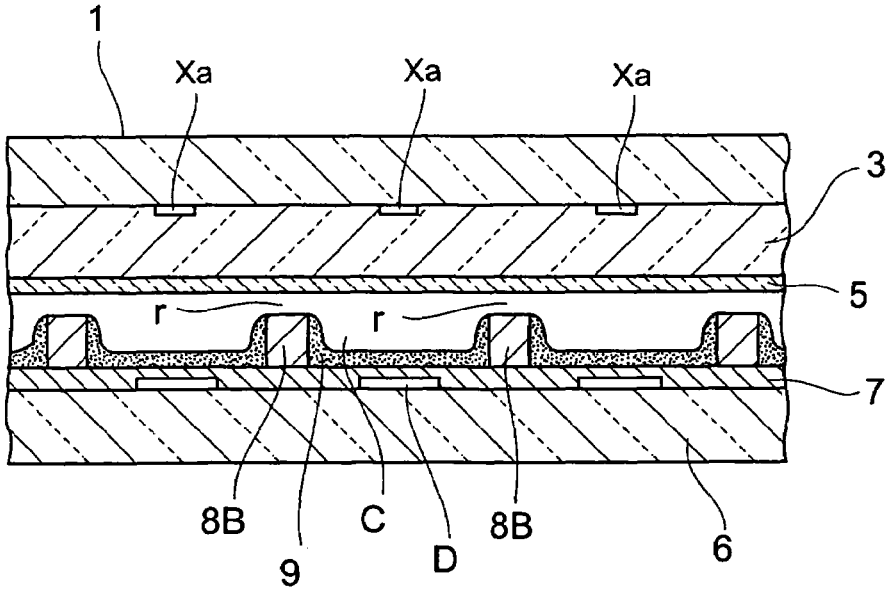
FIG. 3 is a sectional view taken along the W-W line in FIG. 1.

FIGS. 1 to 3 illustrate an example of the structure of a plasma display panel (hereinafter referred to as "PDP") subject to application of the present invention. FIG. 1 is a schematic front view of the PDP in the embodiment. FIG. 2 is a sectional view taken along the V-V line in FIG. 1. FIG. 3 is a sectional view taken along the W-W line in FIG. 1.

The PDP in FIGS. 1 to 3 has a plurality of row electrode pairs (X, Y) extending in a row direction of a front glass substrate 1 (the right-left direction in FIG. 1) and arranged in parallel on the rear-facing face of the front glass substrate 1 serving as the display surface.

A row electrode X is composed of T-shaped transparent electrodes Xa formed of a transparent conductive film made of ITO or the like, and a bus electrode Xb formed of a metal film. The bus electrode Xb extends in the row direction of the front glass substrate 1. The narrow proximal end (corresponding to the foot of the "T") of each transparent electrode Xa is connected to the bus electrode Xb.

Likewise, a row electrode Y is composed of T-shaped transparent electrodes Ya formed of a transparent conductive film made of ITO or the like, and a bus electrode Yb formed of a metal film. The bus electrode Yb extends in the row direction of the front glass substrate 1. The narrow proximal end of each transparent electrode Ya is connected to the bus electrode Yb.

The row electrodes X and Y are arranged in alternate positions in a column direction of the front glass substrate 1 (the vertical direction in FIG. 1). In each row electrode pair (X, Y), the transparent electrodes Xa and Ya are regularly spaced along the associated bus electrodes Xb and Yb and each extend out toward its counterpart in the row electrode pair, so that the wide distal ends (corresponding to the head of the "T") of the transparent electrodes Xa and Ya face each other with a discharge gap g having a required width in between.

Black- or dark-colored light absorption layers (light-shield layers) 2 are further formed on the rear-facing face of the front glass substrate 1. Each of the light absorption layers 2 extends in the row direction along and between the back-to-back bus electrodes Xb and Yb of the row electrode pairs (X, Y) adjacent to each other in the column direction.

A dielectric layer 3 is formed on the rear-facing face of the front glass substrate 1 so as to cover the row electrode pairs (X, Y), and has additional dielectric layers 4 projecting from the rear-facing face thereof toward the rear of the PDP. Each of the additional dielectric layers 4 extends in parallel to the back-to-back bus electrodes Xb, Yb of the adjacent row electrode pairs (X, Y) in a position opposite to the bus electrodes Xb, Yb and the area between the bus electrodes Xb, Yb.

A protective layer 5 is formed on the rear-facing faces of the dielectric layer 3 and the additional dielectric layers 4.

The structure of the protective layer 5 will be described in detail later.

The front glass substrate 1 is parallel to a back glass substrate 6 on both sides of a discharge space S. Column electrodes D are arranged in parallel at predetermined intervals on the front-facing face of the back glass substrate 6. Each of the column electrodes D extends in a direction at right angles to the row electrode pair (X, Y) (i.e. the column direction) in a position opposite to the paired transparent electrodes Xa and Ya of each row electrode pair (X, Y).

On the front-facing face of the back glass substrate 6, a white column-electrode protective layer (dielectric layer) 7 covers the column electrodes D and in turn partition wall units 8 are formed on the column-electrode protective layer 7.

Each of the partition wall units 8 is formed in a substantial ladder shape of a pair of transverse walls 8A and vertical walls 8B. The transverse walls 8A each extend in the row direction in the respective positions opposite to the bus electrodes Xb and Yb of each row electrode pair (X, Y). The vertical walls 8B each extend in the column direction between the pair of transverse walls 8 in a mid-position between the adjacent column electrodes D. The partition wall units 8 are regularly arranged in the column direction in such a manner as to form an interstice SL extending in the row direction between the back-to-back transverse walls 8A of the adjacent partition wall sets 8.

The ladder-shaped partition wall units 8 partition the discharge space S between the front glass substrate 1 and the back glass substrate 6 into quadrangles to form discharge cells C in positions each corresponding to the paired transparent electrodes Xa and Ya of each row electrode pair (X, Y).

In each discharge cell C, a phosphor layer 9 covers five faces: the side faces of the transverse walls 8A and the vertical walls 8B of the partition wall unit 8 and the face of the column-electrode protective layer 7. The three primary colors, red, green and blue, are individually applied to the phosphor layers 9 such that the red, green and blue discharge cells C are arranged in order in the row direction.

A portion of the protective layer 5 covering the surface of the additional dielectric layer 4 is in contact with the front-facing face of the transverse wall 8A of the partition wall unit 8 (see FIG. 2), to thereby block off the discharge cell C and the interstice SL from each other. However, a clearance r is formed between the front-facing face of the vertical wall 8B and the protective layer 5, so that the adjacent discharge cells C in the row direction communicate with each other by means of the clearance r.

The discharge space S defined between the front glass substrate 1 and the back glass substrate 6 is filled with a discharge gas including 10 percent by volume or more of xenon.

Next, the structure of the foregoing protective layer 5 is described.

The protective layer 5 of the PDP is formed of a cesium complex oxide.

Examples of a cesium oxide that can be used for forming the protective layer 5 include $Cs_2CO_3$, $Cs_2SO_4$, $Cs_2No_3$, and complex oxides represented by the general formula Csx (AyOz) and Csx(AByOz), such as $Cs_2Al_2O_4$, $Cs_2SiO_3$, $CsAlSiO_4$, $CsAlSi_2O_6$, $CsLaSiO_4$, $Cs_2MoO_4$, $CsNbO_3$, $CsTaO_3$, $CS_2WO_4$, $Cs_2ZrO_3$, $Cs_2CrO_4$, $Cs_2TiO_3$, and the like.

The protective layer 5 of the cesium oxide is formed, for example, by screen printing techniques, vapor deposition techniques or CVD (Chemical Vapor Deposition) techniques, or alternatively by coating on by spin coating techniques, slit coating techniques, spraying techniques or the like.

$Cs_2CO_3$ and $Cs_2SO_4$ can be dissolved in pure water for coating on to form the protective layer 5.

In a PDP so designed, a reset discharge, an address discharge and a sustaining discharge are caused in the discharge cell C to form an image.

More specifically, in the reset period, the reset discharge is concurrently caused between the paired transparent electrodes Xa and Ya of all the row electrode pairs (X, Y). The reset discharge results in the complete erasure of the wall charge from a portion of the dielectric layer 3 adjoining each discharge cell C (or the deposition of wall charge on the same portion). Then, in the address period, the address discharge is caused selectively between the transparent electrode Ya of the row electrode Y and the column electrode D. Thereupon, the light-emitting cells having the deposition of wall charge on the dielectric layer 3 and the light-extinguishing cells in which the wall charge has been erased from the face of the dielectric layer 3 are distributed over the panel surface in accordance with an image to be displayed. In the following sustaining discharge period, the sustaining discharge is caused between the paired row electrodes Xa and Ya of the row electrode pair (X, Y) in each light-emitting cell.

By means of this sustaining discharge, vacuum ultraviolet light is emitted from the xenon included in discharge gas. The phosphor layers 7 of the primary colors, red, green and blue, are excited by the vacuum ultraviolet light to emit visible color light, thereby forming the image on the panel surface.

In the operation of the PDP designed in this manner, the protective layer 5 formed of the cesium oxide has a low work function, and a higher coefficient of secondary electron emission than that of a MgO made protective layer. Hence, the protective layer 5 operates stably as a protective layer of the PDP, leading to a stable reduction in discharge voltage of the discharge produced in the discharge space S.

The typical tendency of compounds is that the stronger the crystal ionicity of the compound, the easier the release of electrons and the higher the coefficient of secondary electron emission. This is correlated to an increase in the electric dipole. The electric dipole is represented as (the difference in electronegativity between two pairs)×(the sum of ionic radiuses of the two pairs) in a simple case of two anion-cation pairs.

Cesium is the element with the lowest electronegativity (0.7 Pauling's) among the existing elements. The cesium has the property of very easily emitting electrons, and has a relatively large ionic radius so as to be advantageous for an increase in the electric dipole.

A preferable element as the partner of the cesium has a high electronegativity. Examples of elements meeting this requirement include oxygen (3.5 Paulings's), chlorine (3 Pauling's), fluorine (4 Pauling's), nitrogen (3 Pauling's), carbon (2.5 Pauling's), sulfur (2.5 Pauling's), bromine (2.8 Pauling's) and iodine (2.5 Pauling's).

In this connection, the studies made by the inventor of the present invention have revealed that a layer formed of crystals including oxygen operates stably as the protective layer of the PDP.

It can be seen from the foregoing that the cesium oxides forming the protective layer 5 contribute to a stable reduction in discharge voltage in the PDP.

For example, the discharge starting voltage is 210 V in a conventional PDP having an MgO protective layer. In contrast, when the protective layer is formed of $Cs_2CO_3$ or $Cs_2SO_4$ applied by screen printing techniques, the discharge starting voltage drops to 150V in the use of a $Cs_2CO_3$ protective layer, and to 175V in the use of a $Cs_2SO_4$ protective layer.

Note that $Cs_2O$ which is a pure oxide of cesium is apt to change in its properties and is hard to handle. The use of a more stable oxygen salt or complex oxides for forming the protective layer is preferable.

The MgO used in the conventional PDP has a wide band gap and therefore seldom produces the emission of electrons from Xe ions. On the other hand, the cesium oxides produce the emission of electrons from Xe ions. For this reason, a higher Xe-ion concentration in the discharge gas is preferable and the concentration of Xe in the discharge gas is set at 10% or more by volume in the embodiment as described earlier.

In the PDP of the present invention, the protective layer 5 formed of cesium oxides has a high coefficient of secondary electron emission than that of a conventional protective layer formed of MgO. Hence, as compared with the conventional MgO protective layer, when the same number of ions enters, the protective layer 5 causes an increase in the amount of electrons emitted, resulting in a reduction in energy loss and improvement in the light-emitting efficiency.

The conventional PDP having the MgO protective layer is capable of improving the light-emitting efficiency by increasing the Xe concentration in the discharge gas or by setting a long discharge gap between the discharge electrodes, while on the other hand having the disadvantage of a rise in discharge voltage because of the improvement in the light-emitting efficiency.

However, in the PDP of the present invention, because the protective layer 5 is formed of cesium oxides, the discharge voltage drops as described earlier. As a result, it is possible to simultaneously achieve the reduction in discharge voltage and the improvement in the light-emitting efficiency.

Further, because the PDP of the present invention has the protective layer 5 formed of cesium oxides, discharge leakage is mended. This makes it possible to increase the gradation of the PDP and reduce the costs for the address driver based on signal scan.

Further, the cesium oxide protective layer 5 is capable of being formed easily by, for example, a method of powder printing, and further has the feature of being less subject to spattering and being in a stable state because a cesium oxide is stable in the atmosphere as compared with simple substance cesium.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel, comprising:

a pair of substrates placed opposite each other with a discharge space defined between the pair of substrates;

electrodes formed on an inner face of one of the pair of substrates;

a dielectric layer covering the electrodes;

a discharge gas filling the discharge space; and a protective layer is formed in a monolayer on the dielectric layer, and includes a cesium complex-based oxide selected from the group consisting of $Cs_2SO_4$, $Cs_2Al_2O_4$, $Cs_2SiO_3$, $CsAlSiO_4$, $CsAlSi_2O_6$, $CsLaSiO_4$, $Cs_2MoO_4$, $CsNbO_3$, $CsTaO_3$, $Cs_2WO_4$, $Cs_2ZrO_3$, $Cs_2CrO_4$, $Cs_2TiO_3$.

2. A plasma display panel according to claim 1, wherein the discharge gas includes 10% or more by volume of xenon.

3. A plasma display panel according to claim 1, wherein the protective layer is formed by coating a paste including the cesium-based complex oxide onto a surface of the dielectric layer.

4. A plasma display panel according to claim 1, wherein the protective layer is formed by screen-printing the cesium-based complex oxide onto a surface of the dielectric layer.

5. A plasma display panel according to claim 1, wherein the protective layer is formed by evaporating the cesium-based complex oxide onto a surface of the dielectric layer.

6. A plasma display panel according to claim 1, wherein the protective layer is formed by using CVD technique to evaporate the cesium-based complex oxide onto a surface of the dielectric layer.

* * * * *